US007520490B1

(12) United States Patent
Lee

(10) Patent No.: US 7,520,490 B1
(45) Date of Patent: Apr. 21, 2009

(54) ANCHOR WINCH

(75) Inventor: Yun-Hsin Lee, Taoyuan Hsien (TW)

(73) Assignee: Grand Winches Industry Co., Ltd., Taoyuan Hsien (TW)

( * ) Notice: Subject to any disclaimer, the term of this patent is extended or adjusted under 35 U.S.C. 154(b) by 0 days.

(21) Appl. No.: 12/204,085

(22) Filed: Sep. 4, 2008

(51) Int. Cl.
*B66D 1/30* (2006.01)

(52) U.S. Cl. ..... 254/372; 254/358; 254/383

(58) Field of Classification Search ..... 254/372, 254/358, 382, 383
See application file for complete search history.

(56) References Cited

U.S. PATENT DOCUMENTS 5,314,166 A * 5/1994 Muir ..... 254/371
5,803,008 A * 9/1998 Georgens et al. ..... 114/293
6,394,421 B1 * 5/2002 Henly ..... 254/365
6,708,954 B2 * 3/2004 Chambers ..... 254/339

* cited by examiner

*Primary Examiner*—Emmanuel M Marcelo
(74) *Attorney, Agent, or Firm*—Pai Patent & Trademark Law Firm; Chao-Chang David Pai

(57) ABSTRACT

An anchor winch has a casing assembly, a motor, a capstan and a chain. The casing assembly has a casing, a guiding cover, a spring and a guiding rail. The guiding cover is mounted on the casing and selectively opens. The spring is connected to the casing and the guiding cover and makes to guiding cover to be capable of opening at any angles. The guiding rail is mounted on the casing adjacent to the guiding cover. The motor is mounted on the casing. The capstan is mounted rotatably on the casing and is driven by the motor. The chain is mounted through the casing and is wound on the capstan. The spring achieves a somewhat loose connection between the casing and the guiding cover, which provides a resilient force preventing the guiding cover from being damaged by the inadvertent impact from the moving chain.

5 Claims, 8 Drawing Sheets

ANCHOR WINCH

BACKGROUND OF THE INVENTION

1. Field of the Invention

The present invention relates to a winch, and more particularly to an anchor winch that has a casing, a chain and guiding cover resiliently connected to the casing and capable of opening when the chain impacts the guiding cover, which prevents the guiding cover from being damaged.

2. Description of Related Art

A conventional anchor winch is used on the board of a boat and has a casing, a motor, a chain and an anchor. The casing has a chain hole, a capstan and a guiding member. The chain hole is defined through the casing. The capstan is mounted rotatably in the casing and has an annular groove and keys. The chain hole is defined radially in the capstan and has an inner surface. The keys are formed radially on the inner surface of the chain groove. The motor is connected to the capstan and may drive the capstan to rotate. The guiding member is mounted securely on the casing by a bolt and partly covers the chain hole. The chain is mounted through the chain hole, is wound in the chain groove of the capstan, is moved by the keys and has a mounting end and a connecting end. The mounting end is mounted the wall of the board. The anchor is mounted on the connecting end of the chain. The guiding member guides the chain to move smoothly around the capstan when the anchor extends out of the boat.

However, the guiding member is mounted securely and tightly on the casing by the bolt and cannot open at will. When the chain retracts/extends and moves through the chain hole, the chain is easily jammed by the guiding member and even damages the guiding member.

To overcome the shortcomings, the present invention provides an anchor winch to mitigate or obviate the aforementioned problems.

SUMMARY OF THE INVENTION

The main objective of the invention is to provide an anchor winch that has a casing, a chain and guiding cover resilient connected to the casing and capable of opening when the chain impacts the guiding cover, which prevents the guiding cover from being damaged.

An anchor winch in accordance with the present invention comprises a casing assembly, a motor, a capstan and a chain. The casing assembly has a casing, a guiding cover, a spring and a guiding rail. The guiding cover is mounted on the casing and selectively opens. The spring is connected to the casing and the guiding cover and makes to guiding cover to be capable of opening at any angles. The guiding rail is mounted on the casing adjacent to the guiding cover. The motor is mounted on the casing. The capstan is mounted rotatably on the casing and is driven by the motor. The chain is mounted through the casing and is wound on the capstan. The spring achieves a somewhat loose connection between the casing and the guiding cover, which provides a resilient force preventing the guiding cover from being damaged by the inadvertent impact from the moving chain.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
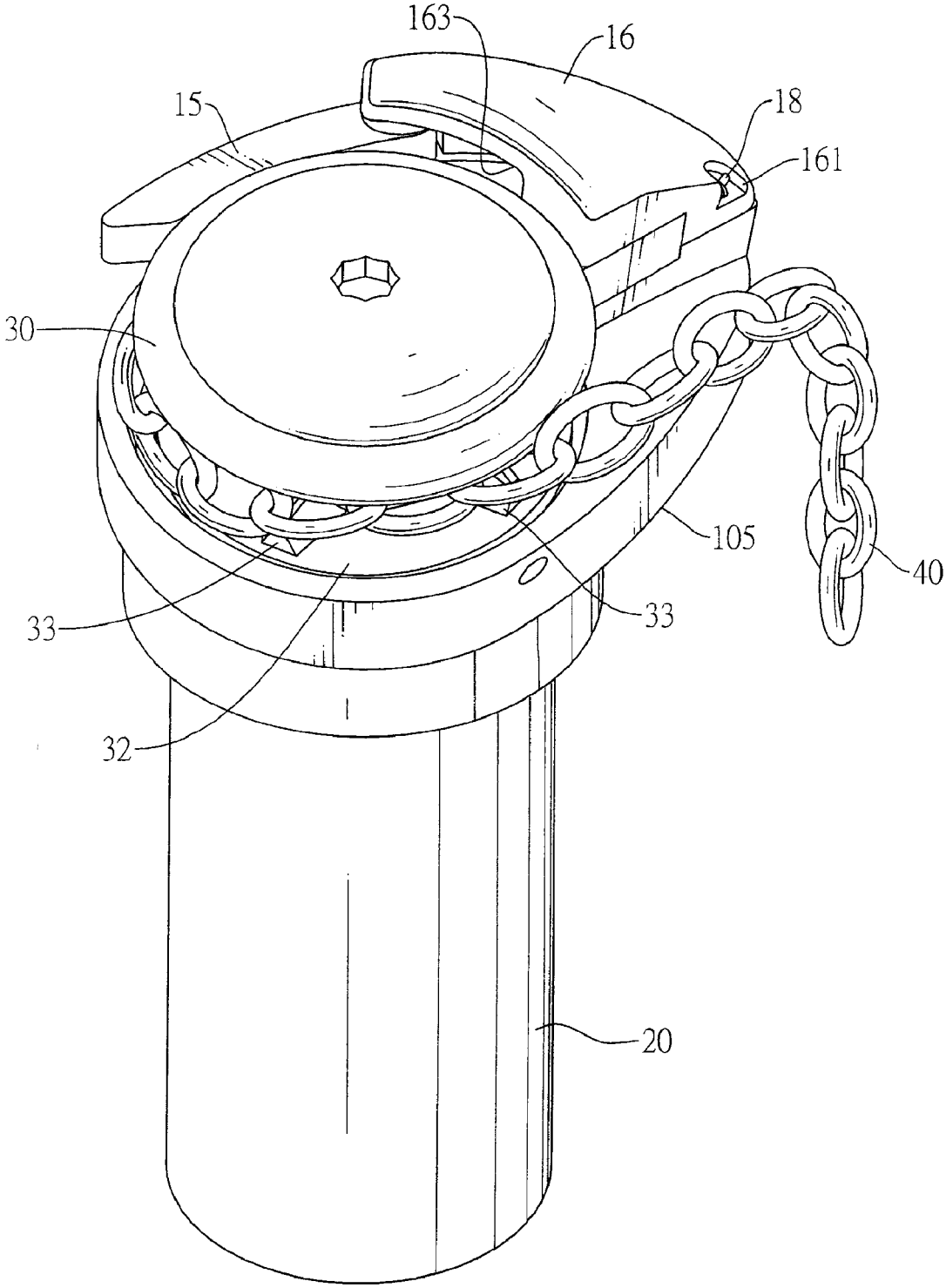
FIG. 1 is a perspective view of a first embodiment of an anchor winch in accordance with the present invention.
Figure 2:
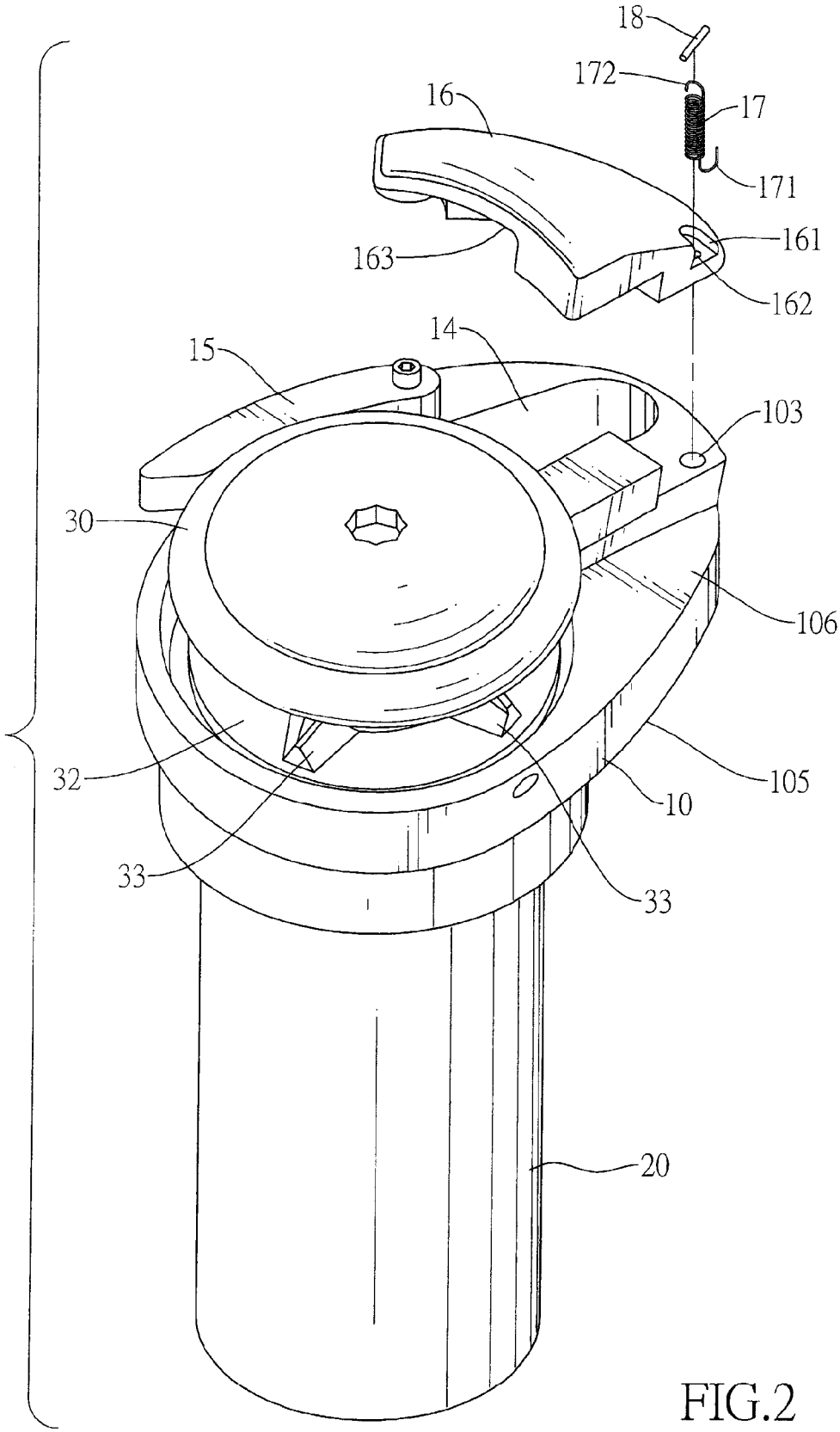
FIG. 2 is a partially exploded perspective view of the anchor winch in FIG. 1 without the chain.

With reference to FIGS. 1 and 2, a first embodiment of an anchor winch in accordance with the present invention is connected to an anchor and comprises a casing assembly, a motor (20), a capstan (30) and a chain (40).

Figure 3:
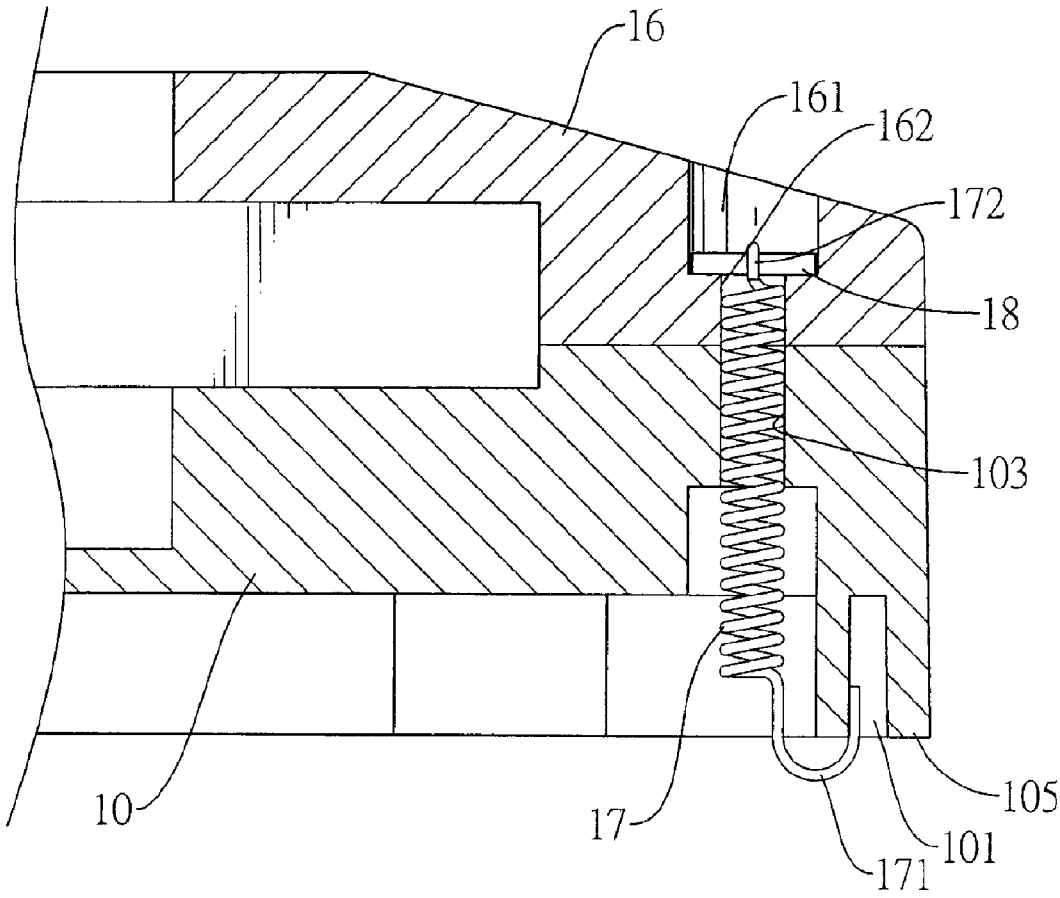
FIG. 3 is a side view in partial section of the anchor winch in FIG. 1.
Figure 4:
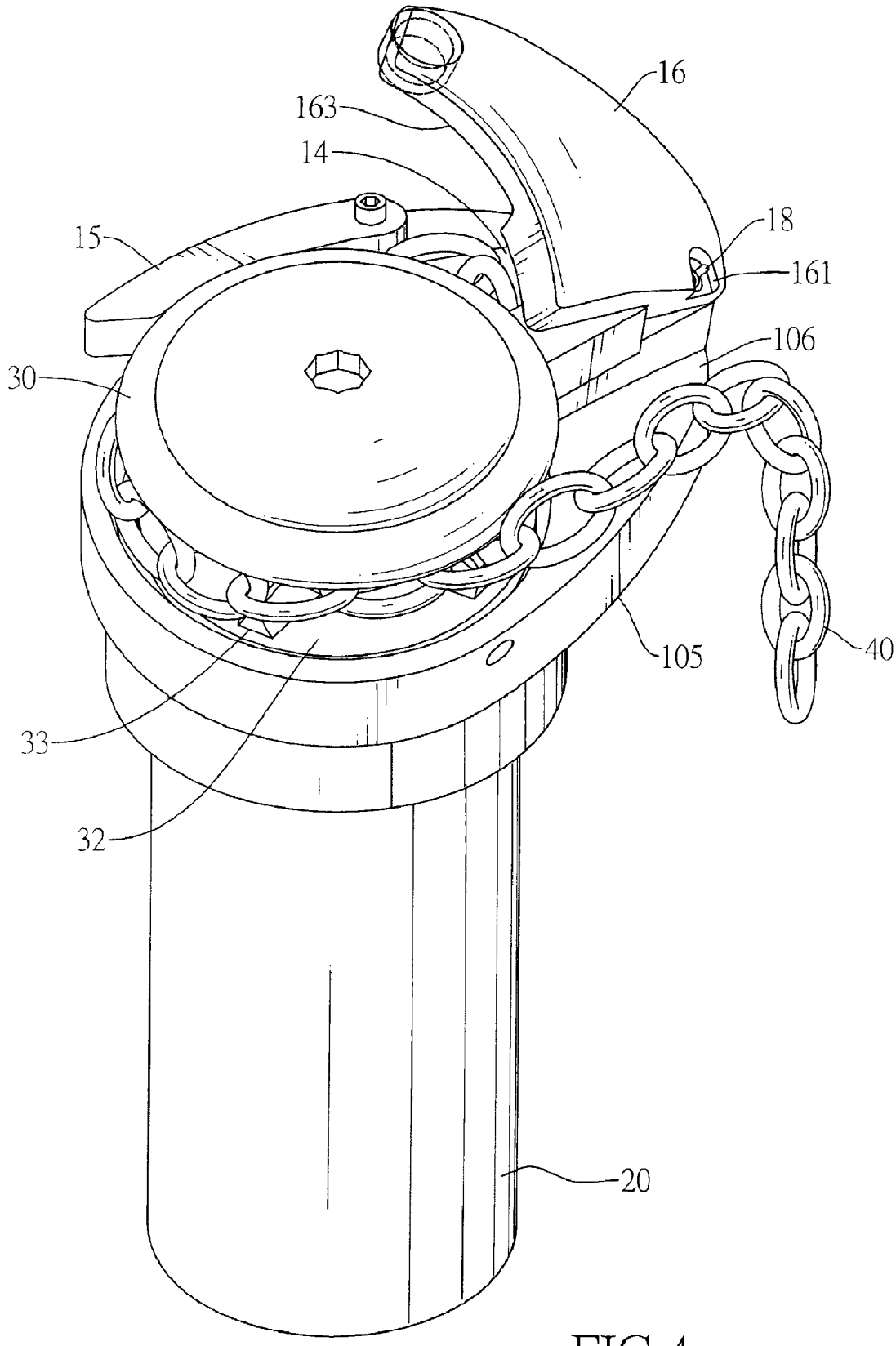
FIG. 4 is an operational perspective view of the anchor winch in FIG. 1 with the guiding member lifted and opened.
Figure 5:
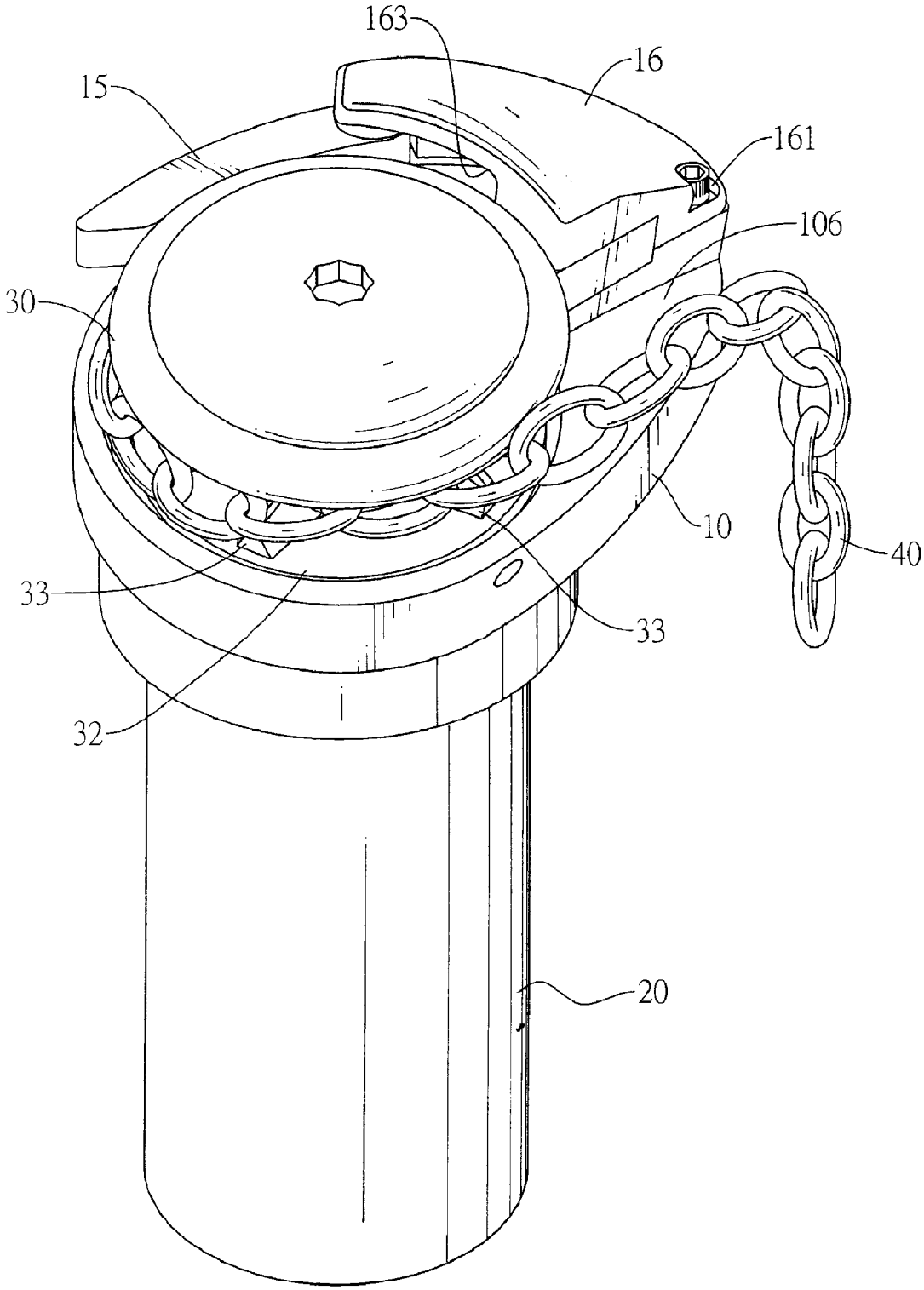
FIG. 5 is a perspective view of a second embodiment of an anchor winch in accordance with the present invention.
Figure 6:
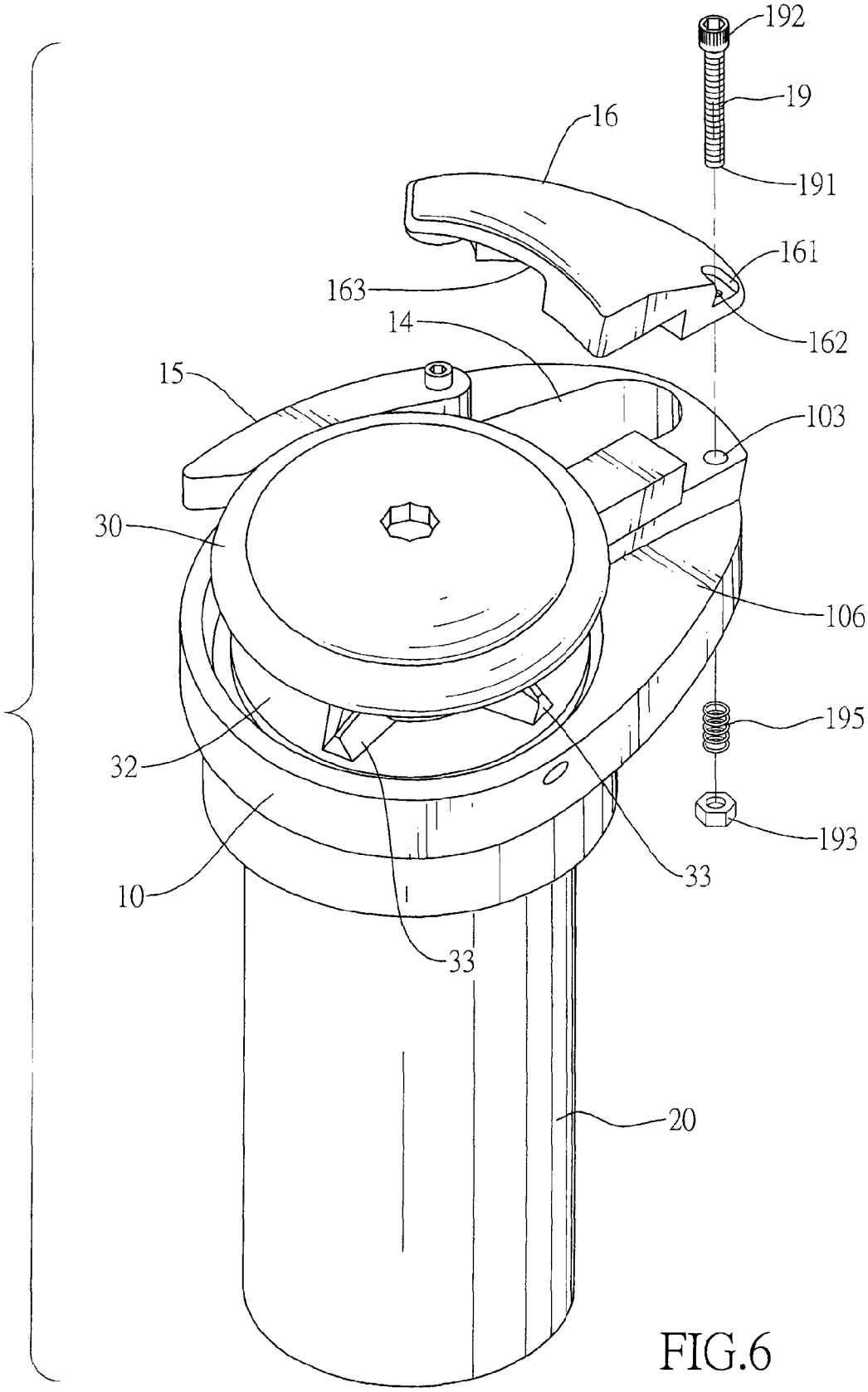
FIG. 6 is a partially exploded perspective view of the anchor winch in FIG. 5 without the chain.
Figure 7:
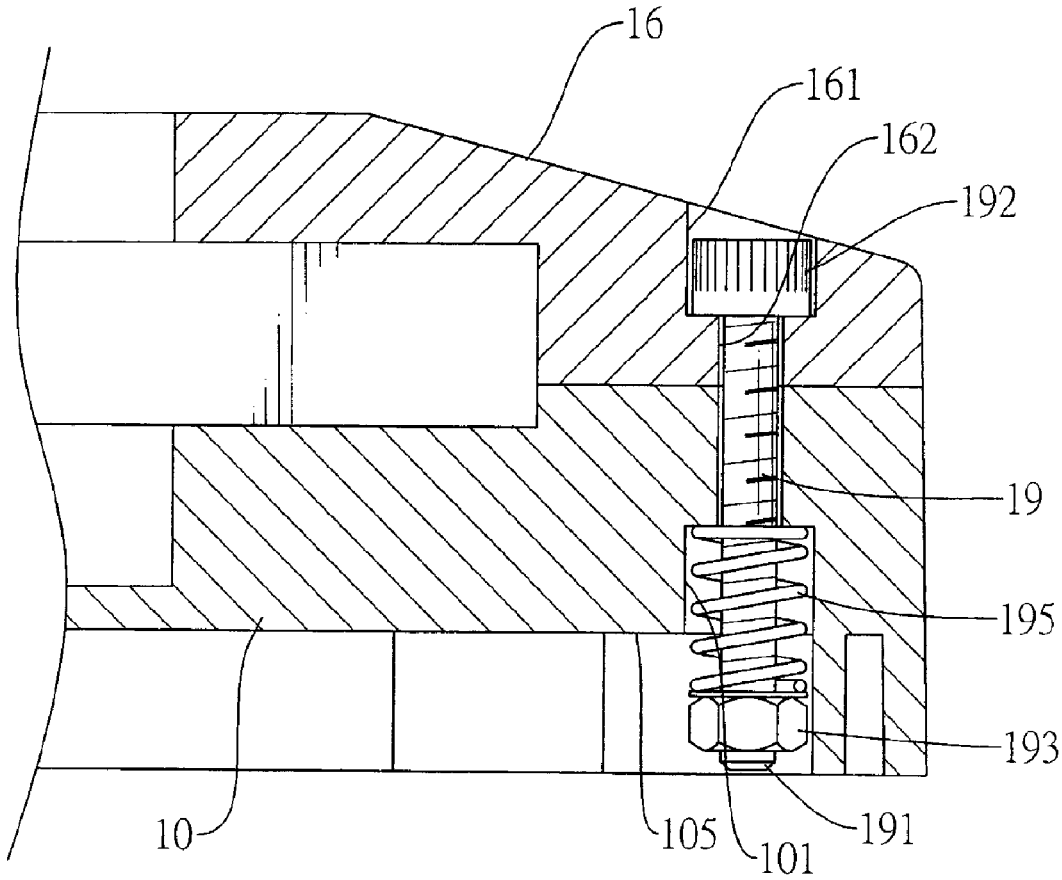
FIG. 7 is a side view in partial section of the anchor winch in FIG. 5.
Figure 8:
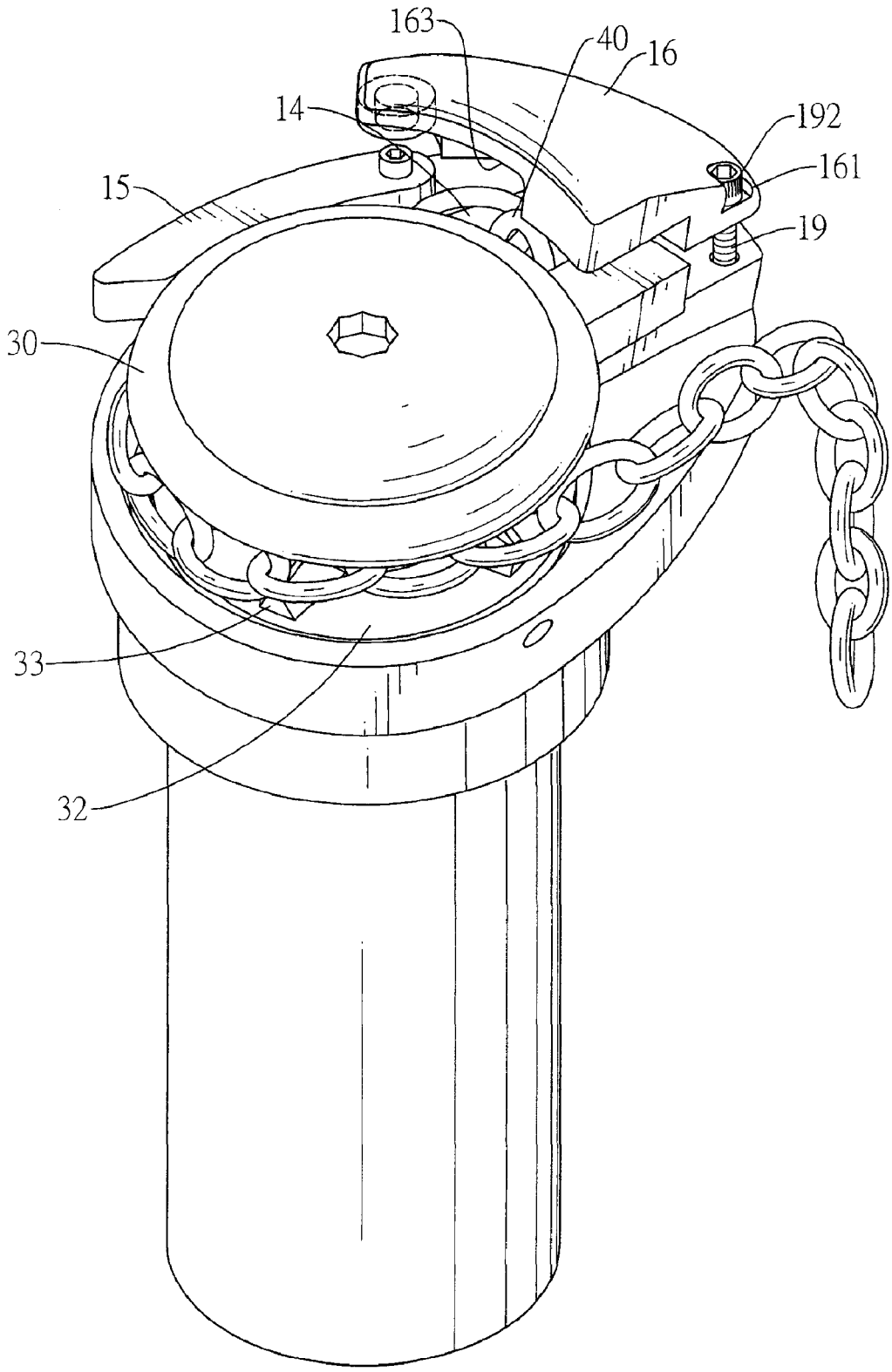
FIG. 8 is an operational perspective view of the anchor winch in FIG. 5 with the guiding member lifted and opened.

With further reference to FIG. 3, the casing assembly has a casing (10), a guiding cover (16), a connecting member and a guiding rail (15).

The casing (10) has an inside surface (105), an outside surface (106), a through hole (103), an inside mounting hole (101) and a chain hole (14). The through hole (103) is defined through the casing (10) from the outside surface (106) to the inside surface (105). The inside mounting hole (101) is defined in the inside surface (105). The chain hole (14) may be a slot, is defined through the casing (10) from the outside surface (106) to the inside surface (14).

The guiding cover (16) is mounted on the outside surface (106) of the casing (10), partially covers the chain hole (14), selectively opens at any angles and has an outer surface, an inner surface, a mounting recess (161), a through bore (162) and an open recess (163). The mounting recess is defined in the outer surface of the guiding cover (16) and has an inner bottom surface. The through hole (162) is defined through the inner bottom surface of the mounting recess (161). The open recess (163) is defined in the inner surface of the guiding cover (16) and communicates with the chain hole (14) in the casing (10).

The connecting member resiliently connects the casing (10) to the guiding cover (16), biases the guiding cover (16) to press against the outside surface (106) of the casing (10) and partially cover the chain hole (14) and is mounted through the through hole (103) of the casing (10) and the through bore (162) of the guiding cover (16). In the first embodiment, the connecting member is a spring (17). With the spring (17), the guiding cover (16) is capable of opens at any angles when external force inadvertently impacts the guide cover (16). Thus, the spring (17) achieves a somewhat loose connection between the casing (10) and the guiding cover (16), which provides a resilient force cushioning and preventing the guiding cover (16) from being damaged by the inadvertent impact of the external force from an entangled chain. The spring (17) has an inside hooking end (171) and an outside mounting end (172). The inside hooking end (171) hooks into the inside mounting end (101) of the casing (10). The outside mounting end (172) extends in the mounting recess (161) of the guiding cover (16) and is mounted around a pin (18) abutting tightly against the inner bottom surface of the mounting recess (161).

The guiding rail (15) is mounted on the outside surface (106) of the casing (10) and adjacent to the open recess (163) of the guiding cover (16).

The motor (20) is mounted on the inside surface (105) of the casing (10).

The capstan (30) is mounted rotatably on the outside surface (106) of the casing (10), is connected to and driven by the motor to rotate to retract a chain and has an annular groove (32) and multiple keys (33). The annular groove (32) is defined radially in the capstan (30) and has an inner surface. The keys (33) are formed radially on the inner surface of the annular groove (30).

The chain (40) is mounted through the chain hole (14) in the casing (10), extends out of the open recess (163) of the guiding cover (16) and is guided by the guiding cover (16) and the guide rail (15) to extend along the guiding rail (15), is wound in the annular groove (32) of the capstan (30). The chain (40) is engaged with the keys (33) so that the rotating capstan (30) retracts/extends the chain (40). The chain (41) has a mounting end and a connecting end. The mounting end is mounted on a wall of a boat. The connecting end is connected to an anchor.

When the chain (40) retracts from the outside surface (106) to the inside surface (105) of the casing (10) or extends from the inside surface (105) to the outside surface (106), the guiding cover (40) is easily pushed or pressed by the moving chain (40). The spring (17) cushions and allows the guiding cover (16) to open at any angles in response to the impact from the moving chain (40). After the anchor on the chain (40) is released or retracts completely, the pressed or pushed guiding cover (16) recoils to the closing positioning. Therefore, the chain (40) would not jammed with the guiding cover (16) and the impact of the chain (40) would not damage the guiding cover (16).

With reference to FIGS. 5-8, a second embodiment of the anchor winch in accordance with the present invention is similar to the first embodiment and the connecting member is a bolt assembly. The bolt assembly resiliently connects the casing (10) to the guiding cover (16) and has a bolt (19), a nut and a compression spring (195). The bolt (19) is mounted through the through hole (103) of the casing (10) and the through bore (162) of the guiding cover (16) and has an inside end (191) and an enlarged outside end (192). The inside end (191) extends out of the inside surface (105) of the casing (10). The enlarged outside end (192) is mounted in the mounting recess (161) and presses against the inner bottom surface of the mounting recess (161). The nut (193) is screwed on the inside end (193) of the bolt (19). The compression spring (195) is mounted around the bolt (19) and has two ends pressing respectively to the nut (193) and the inside surface (105) of the casing (10). With the bolt assembly, the guiding cover (16) may be opened when the chain (40) pushes the guiding cover (16).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An anchor winch comprising:

a casing assembly having a casing having an inside surface;

an outside surface;

a through hole defined through the casing from the outside surface to the inside surface; and a chain hole defined through the casing from the outside surface to the inside surface;

a guiding cover mounted on the outside surface of the casing, partially covering the chain hole, selectively opening and having an inner surface and an open recess defined in the inner surface and communicating with the chain hole;

a connecting member resiliently connecting the casing to the guiding cover, biasing the guiding cover to press against the outside surface of the casing and to partially cover the chain hole and mounted through the through hole of the casing; and a guiding rail mounted on the outside surface of the casing and adjacent to the open recess of the guiding cover;

a motor mounted on the casing;

a capstan mounted rotatably on the outside surface of the casing, connected to and driven by the motor to rotate and having an annular groove defined radially in the capstan and having an inner surface; and a chain mounted through the chain hole in the casing, extending out of the open recess of the guiding cover, guided by the guiding cover and the guiding rail to extend along the guiding rail, wound in the annular groove of the capstan.

2. The anchor winch as claimed in claim 1, wherein the casing further has an inside mounting hole defined in the inside surface of the casing;

the guiding cover further has a mounting recess defined in the outer surface of the guiding cover and an inner bottom surface; and a through bore defined through the inner bottom surface of the mounting recess;

the connecting member is a spring, the spring has an inside hooking end hooking into the inside mounting end of the casing; and an outside mounting end extending in the mounting recess of the guiding cover and mounting around a pin that abuts against the inner bottom surface of the mounting recess.

3. The anchor winch as claimed in claim 2, wherein the capstan further has multiple keys formed radially in the inner surface of the annular groove; and the chain is engaged with the keys so that rotating the capstan moves the chain.

4. The anchor winch as claimed in claim 1, wherein the connecting member is a bolt assembly having a bolt mounted through the through hole of the casing and the through bore of the guiding cover and having an inside end extending out of the inside surface of the casing; and an enlarged outside end mounted in the mounting recess and pressing against the inner bottom surface of the mounting recess;

a nut screwed on the inside end of the bolt; and a compression spring mounted around the bolt and having two ends pressing respectively to the nut and the inside surface of the casing.

5. The anchor winch as claimed in claim 4, wherein the capstan further has multiple keys formed radially in the inner surface of the annular groove; and the chain is engaged with the keys so that rotating the capstan moves the chain.

* * * * *